United States Patent [19]

Ito et al.

[11] Patent Number: 4,512,318

[45] Date of Patent: Apr. 23, 1985

[54] INTERNAL COMBUSTION ENGINE WITH FUEL INJECTION SYSTEM

[75] Inventors: Toshimitsu Ito; Toshiaki Isobe, both of Aichi, Japan

[73] Assignee: Toyota Jidosha Kabushiki Kaisha, Toyota, Japan

[21] Appl. No.: 418,838

[22] Filed: Sep. 16, 1982

[30] Foreign Application Priority Data

Sep. 18, 1981 [JP] Japan ..... 56-147314

[51] Int. Cl.[3] ..... F02D 5/02

[52] U.S. Cl. ..... 123/492; 123/493

[58] Field of Search ..... 123/492, 493, 480

[56] References Cited

U.S. PATENT DOCUMENTS

| | | | |
|---|---|---|---|
| 4,245,605 | 1/1981 | Rice et al. | 123/492 |
| 4,313,412 | 2/1982 | Hosaka et al. | 123/480 |
| 4,359,993 | 11/1982 | Carlson | 123/492 |
| 4,364,363 | 12/1982 | Miyagi et al. | 123/492 |

*Primary Examiner*—Tony M. Argenbright

*Attorney, Agent, or Firm*—Cushman, Darby & Cushman

[57] ABSTRACT

An engine wherein a basic fuel injection flow rate from an injector is obtained based on an intake manifold pressure and an engine rotational speed. A change with time of the opening degree of a throttle valve and a change with time of the intake manifold pressure are calculated, and the basic fuel injection flow rate is corrected commensurate with the values of the changes described above to cause the basic fuel injection flow rate to be an ideal air-fuel ratio. When the change with time in opening degree of the throttle valve or the change with time of the intake manifold pressure is smaller than the respective predetermined values, the basic fuel injection flow rate is corrected, and, after the correction, if the values of changes thereof become smaller than the respective predetermined values, the basic fuel injection flow rate thus corrected is caused to approach the injection flow rate before the correction.

12 Claims, 6 Drawing Figures

IGNITION SIGNAL
FUEL INJECTION SIGNAL
AIR VALVE SIGNAL
40
48
I/O
42
RAM
44
ROM
46
CPU
IGNITION CONFIRMATION SIGNAL
IGNITION SWITCH SIGNAL
AIR-FUEL RATIO SIGNAL
ENGINE ROTATIONAL SPEED SIGNAL
50
A
D
C
WATER TEMPERATURE SIGNAL
INTAKE AIR TEMPERATURE SIGNAL
INTAKE MANIFOLD PRSSURE SIGNAL
THROTTLE POSITION SIGNAL
52

INTERNAL COMBUSTION ENGINE WITH FUEL INJECTION SYSTEM

BACKGROUND OF THE INVENTION

This invention relates to an internal combustion engine with a fuel injection system, and more particularly to an internal combustion engine with a fuel injection system wherein a fuel flow rate is controlled in accordance with an intake manifold pressure and an engine rotational speed.

Heretofore, the internal combustion engine (a so-called D-J engine) of the type described has been commonly operated at about the maximum output air-fuel ratio, i.e., on the side richer than the stoichiometric air fuel ratio, in consideration of the driveability. However, when a three-way catalyst is used to meet the engine exhaust gas control regulations, the purification factor of the three-way catalyst for contents in the exhaust gas including $NO_x$, CO and HC can be high only when an air-fuel ratio is within a small region in a visinity of a stoichiometric air-fuel ratio. Therefore, in order to utilize the purification factor to the maximum, it is necessary to operate the engine at the stoichiometric air-fuel ratio.

In the D-J engine, the intake air-flow rate is determined in accordance with the intake manifold pressure and the engine rotational speed so that fuel commensurate to the intake air flow rate is injected to obtain a predetermined air-fuel ratio. With the D-J engine as described above, it has been known that, as for the air-fuel ratio during transitional condition such as acceleration and deceleration, the air-fuel ratio during acceleration becomes lean, and conversely, that during deceleration becomes rich. Accordingly, both the exhaust gas control and the driveability are not satisfactorily attained because of such phenomena in the air-fuel ratio during the transitional conditions.

SUMMARY OF THE INVENTION

The present invention has been developed to obviate the above-described disadvantages of the prior art and has as its object the provision of an internal combustion engine with a fuel injection system wherein an air-fuel ratio is accurately controlled and emission and driveability are maintained at the optimum conditions.

In accordance with the present invention, there is provided an internal combustion engine with a fuel injection system comprising:

- an injector for injecting fuel;
- a rotation sensor for detecting a rotational speed of said engine;
- a throttle sensor for detecting an opening degree of a throttle valve of said engine;
- a pressure sensor for detecting pressure in an intake manifold of said engine;
- first calculating means for calculating a basic injection time period, during which said injector injects fuel, based on the engine rotational speed detected by said rotation sensor and intake manifold pressure detected by said pressure sensor;
- second calculating means for calculating a change with time of said opening degree detected by said throttle sensor and a change with time of said intake manifold pressure detected by said pressure sensor; and
- correcting means for correcting said basic injection time period to approach the ideal air-fuel ratio based on the change in value with time of said opening degree and/or the change in value with time of said intake manifold pressure calculated by said second calculating means.

DESCRIPTION OF THE PREFERRED EMBODIMENT

Figure 1:
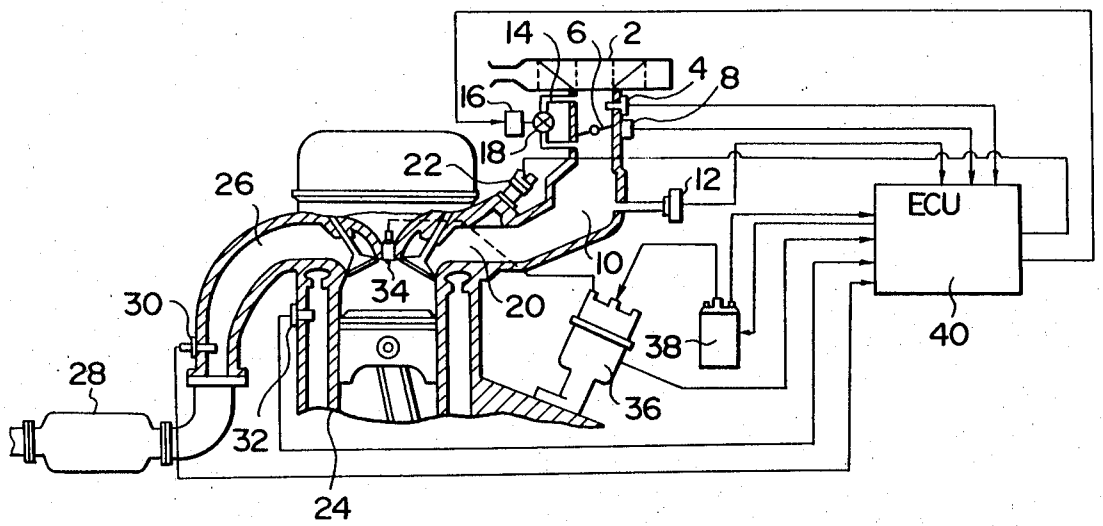
FIG. 1 is a block diagram showing an embodiment of the present invention.

Referring to FIG. 1, reference numeral 2 indicates an air cleaner, and an intake air temperature sensor 4 for detecting an intake air temperature is provided downstream of the air cleaner 2.

A throttle valve 6 is disposed downstream of the intake air temperature sensor 4, and a throttle sensor 8 such as a potentiometer for detecting the opening degree of the throttle valve 6 to output a throttle position signal is disposed close to the throttle valve 6. Provided downstream of the throttle valve 6 is a surge tank 10 which is provided with a pressure sensor 12 for detecting a negative pressure in the intake manifold to output an intake manifold pressure signal and which is connected with a bypass passage 14 bypassing the throttle valve 6. This bypass passage 14 is provided with an intake air flow rate control valve (hereinafter referred to as an "air valve") 18 controlled by a step motor 16. During idling of the engine, the air valve 18 causes the intake air to flow into the surge tank 10, bypassing the throttle valve 6, so that the engine rotational speed can be controlled to a target value.

The surge tank 10 is also connected with an intake manifold 20, into which a fuel injection device 22 is directed. The intake manifold 20 is connected to a combustion chamber of the engine 24 which is connected to a catalytic converter 28, filled up with three-way catalyst, through an exhaust manifold 26. In addition, designated at 30 is an $O_2$ sensor for controlling an air-fuel mixture to the proximity of the stoichiometric air-fuel ratio, and 32 is a water temperature sensor for detecting the engine cooling water temperature.

An ignition plug 34 of the engine 24 is connected to a distributor 36, which in turn is connected to an igniter 38. Additionally, a transmission, not shown, is provided with a shift position sensor including a neutral start switch for detecting a neutral position and a drive position of a shift lever.

The distributor 36 is provided with a gear-like signal rotor affixed to a distributor shaft and a pickup mounted on a housing of the distributor in opposed relation to teeth of the signal rotor, and an engine rotational speed signal is emitted from the pickup in accordance with the change in the quantity of fluxes passing through the pickup as the signal rotor rotates. The timing rotor and pickup constitute an engine rotation sensor.

Figure 2:
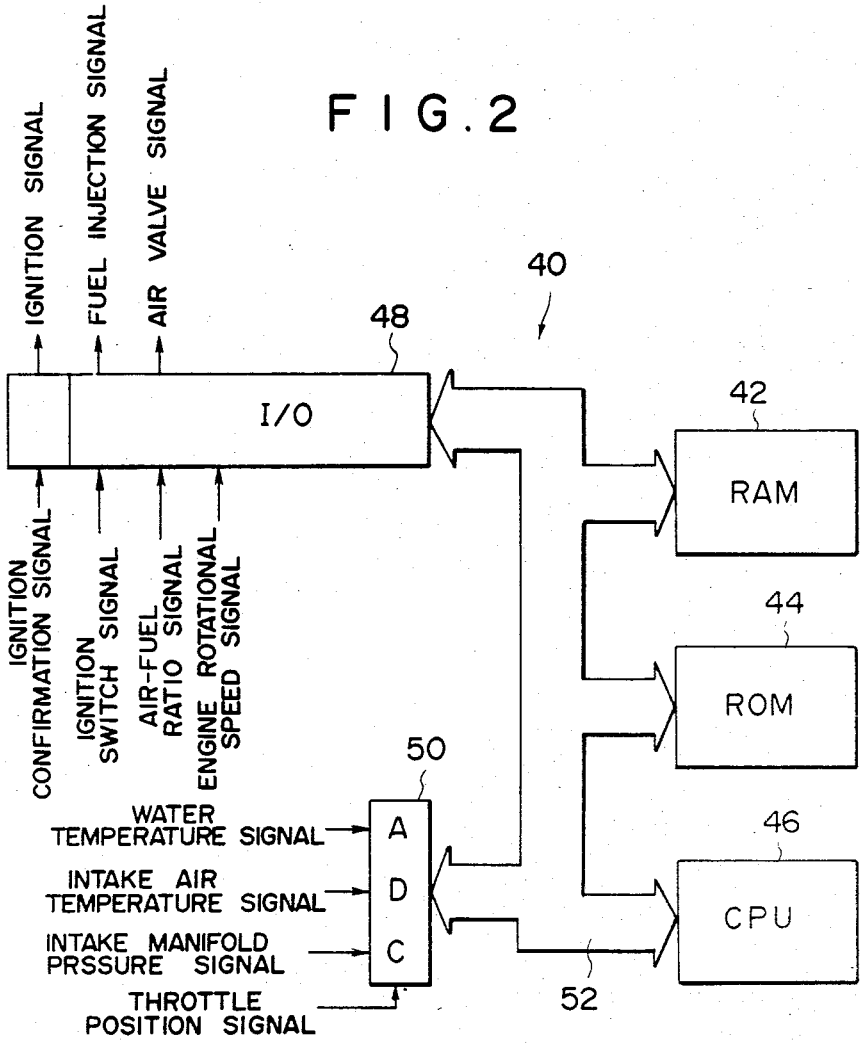
FIG. 2 is a block diagram showing the electronic control circuit in the above-mentioned embodiment.

As shown in FIG. 2, an electronic control circuit 40, to which signals from the aforesaid various sensors are inputted, comprises a random access memory (RAM) 42, a read only memory (ROM) 44, a central processing unit(CPU) 46, an input/output interface (I/O) 48 and analogue-to-digital converter(ADC) 50. The RAM 42, ROM 44, CPU 46, I/O 48 and ADC 50 are connected to one another through a bus line 52 including a data bus. In the ROM 44 of the electronic control circuit 40, there are stored a map relating to a fuel injection time "TAVBASE" of normal running condition, which is determined in accordance with an engine rotational speed NE and an intake manifold pressure PM, and calculating equations (1) through (3) for calculating a fuel injection time "TAV" of acceleration or deceleration. Here, when a correction coefficient is "$K_{TAV}$", the fuel injection time "TAV" may be represented by the following equation.

$$TAV = K_{TAV} \times TAVBASE \quad (1)$$

The correction coefficient $K_{TAV}$ may be given by the following equations.

$$K_{TAV} = 1 + (ACC(TA) \text{ or } ACC(PM)) \quad (2)$$

$$K_{TAV} = 1 + (DEC(TA) \text{ or } DEC(PM)) \quad (3)$$

Where, ACC(TA) and ACC(PM) are respective synchronous increases in flow rate for increasing the fuel injection time "TAV" during acceleration, the former is set in response to a signal from the throttle sensor 8 and the latter in response to an intake manifold pressure signal from the pressure sensor 12. DEC(TA) and DEC(PM) are respective synchronous decreases in flow rate for decreasing the fuel injection time "TAV" during deceleration, the former is set in response to a signal from the throttle sensor 8 and the latter in response to an intake manifold pressure signal from the pressure sensor 12.

The I/O 48 is inputted thereinto with an engine rotational speed signal outputted from the distributor 36, an ignition switch signal outputted from an ignition switch, not shown, an ignition confirmation signal outputted from the igniter 38, an air-fuel ratio signal outputted from the $O_2$ sensor 30 and so forth, while outputting an air valve signal for controlling the air valve 18, a fuel injection signal for controlling the fuel injection device 22, an ignition signal for controlling the igniter 38 and so forth. The ADC 50 is inputted thereinto with an intake manifold pressure signal outputted from the pressure sensor 12, an intake air temperature signal outputted from the intake air temperature sensor 4, a throttle position signal outputted from the throttle sensor 8 and a water temperature signal outputted from the water temperature sensor 32, and the respective signals are converted into digital signals by the ADC 50.

Further, in the ROM 44, there are previously stored various maps and tables corresponding to the controlled conditions of the engine in addition to the aforesaid map and calculating equations, and, in addition to the aforesaid various signals, various signals corresponding to the controlled conditions of the engine are inputted to and outputted from the I/O 48 and the ADC 50.

Figure 3A:
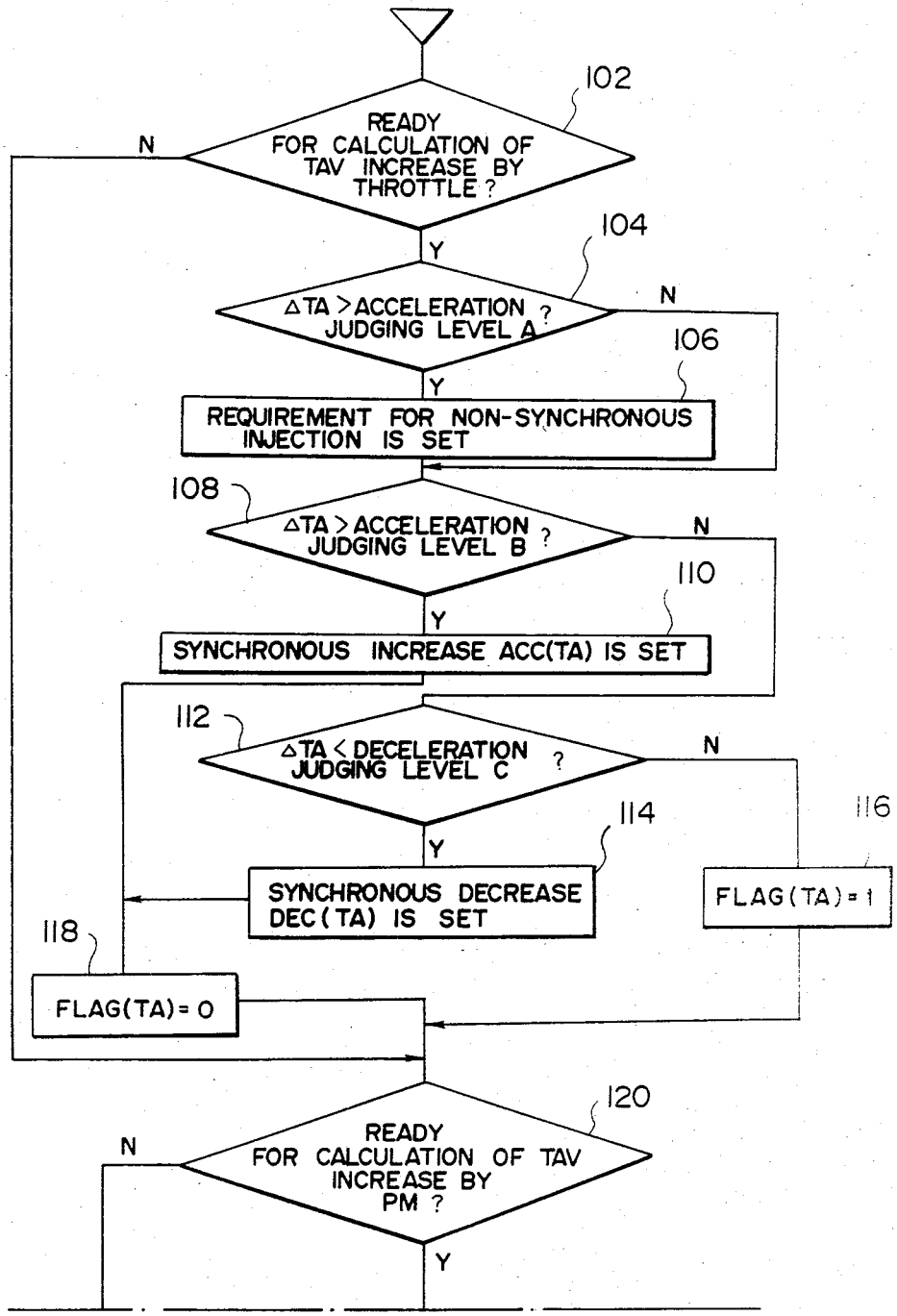
FIGS. 3A and 3B show a flow chart showing the process for changing the correction coefficient during the transitional condition in the above-mentioned embodiment.
Figure 3B:
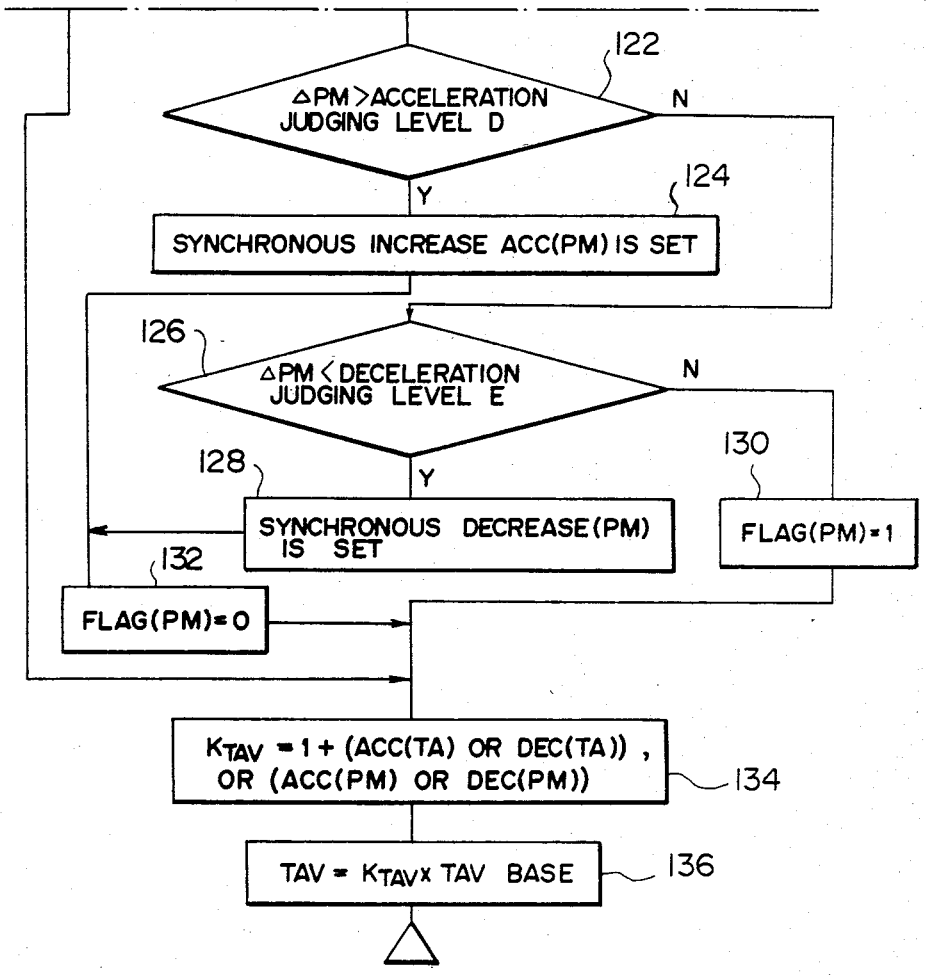
Figure 3:
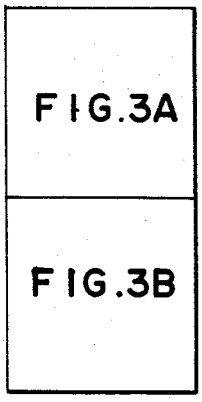

FIG. 3 shows the procedural steps in an embodiment of the present invention during acceleration and deceleration. In the present embodiment, a correcting calculation of the fuel injection time "TAV" is performed every predetermined cycle. In Step 102, it is judged if it is ready to perform a correcting calculation in response to a signal from the throttle sensor 8. If "yes", then the process goes forward to Step 104, where a comparison is made between a change ΔTA in opening degree of the throttle valve 6 at a predetermined time interval and a first acceleration judging level A. If ΔTA>A, the process goes forward to Step 106, where a flag indicating that fuel injection is performed in non-synchronism is set, and the process further goes forward to Step 108.

If ΔTA<A in Step 104, then the process goes forward to Step 108, where comparison is made between ΔTA and a second acceleration judging level B. If ΔTA>B, then the process goes forward to Step 110, where the synchronous increase ACC(TA) for increasingly correcting the fuel injection time "TAVBASE" is stored in the RAM 42, and then, the process goes forward to Step 118. In this Step 118, a flag (TA) for judging whether or not ACC(TA) and DEC(TA) are attenuated is set at "0" so as not to cause the synchronous increase ACC(TA) and the synchronous decrease DEC(TA) to attenuate, and then, the process goes forward to Step 120. If ΔTA<B in Step 108, the process goes to Step 112, where ΔTA is compared with deceleration judging level C. If ΔTA<C in Step 112, then the process goes forward to Step 114, where the synchronous decrease DEC(TA) for decreasingly correcting the fuel injection time "TAVBASE" is stored in the RAM 42. If ΔTA>C in Step 112, then the process goes forward to Step 116, where the flag (TA) is set at "1" so as to cause the synchronous increase ACC(TA) and the synchronous decrease DEC(TA) to attenuate in a flow chart shown in FIG. 4 which will be described hereunder, and the process goes forward to Step 120.

In Step 120, it is judged whether it is ready to perform correcting calculation of the fuel injection time "TAVBASE" in response to an intake manifold pressure signal from the pressure sensor 12. If "yes", then the process goes forward to Step 122, where comparison is made between a change ΔPM of the intake manifold pressure PM at a predetermined time interval and a third acceleration judging level D. If ΔPM>D, then the process goes forward to Step 124, where the synchronous increase ACC(PM) for increasingly correcting the fuel injection time "TAVBASE" is stored in the RAM 42. However, if ACC(TA)>ACC(PM), the synchronous increase ACC(PM) is not stored. More specifically, if ACC(TA)>ACC(PM), then the increase in flow rate is effected by ACC(TA), and only when ACC(TA)≦ACC(PM), increasing correction is made by ACC(PM). Then, the process goes forward to Step 132, where the flag (PM) for judging whether or not ACC(PM) and DEC(PM) are attenuated is set at "0" so as to not to cause the synchronous increase ACC(PM) and the synchronous decrease DEC(PM) to attenuate while ΔPM exceeds a certain value, and then, the process goes forward to Step 134.

If ΔPM<D in Step 122, then the process goes forward to Step 126, where comparison is made between ΔPM and a second deceleration judging level E. If ΔPM<E, then the process goes forward to Step 128, where the synchronous decrease DEC(PM) for decreasingly correcting the fuel injection time "TAVBASE" is stored in the RAM 42, and then the process goes forward to Step 132, where the flag (PM) is set at "0". Then the process goes forward to Step 134.

If $\Delta PM > E$ in step 126 then the process goes forward to step 130, where the (PM) is set at "1". Then the process goes forward to step 134.

In Step 134, calculation in accordance with the aforesaid equation (2) or (3) is performed on the basis of values stored in the RAM 42 in Steps 110, 114, 124 and/or 128, and then, in Step 136, calculation in accordance with the equation (1) is performed to thereby obtain the fuel injection time "TAV". The increase or decrease in flow rate thus ontained is caused to attenuate during normal running condition, and more specifically, when the change $\Delta TA$ in opening degree of the throttle valve 6 is less than a predetermined value or the change $\Delta PM$ of the intake manifold pressure is less than a predetermined value, to become the basic injection time "TAVBASE".

As has been described hereinabove, in this embodiment of the present invention, the changes in opening degree of the throttle valve 6 and the intake manifold pressure are detected and the fuel injection flow rate is increased or decreased commensurate to the values of changes thus detected, thereby obviating the disadvantages of the conventional D-J engine that the air-fuel ratio becomes lean during acceleration and rich during deceleration.

Figure 4:
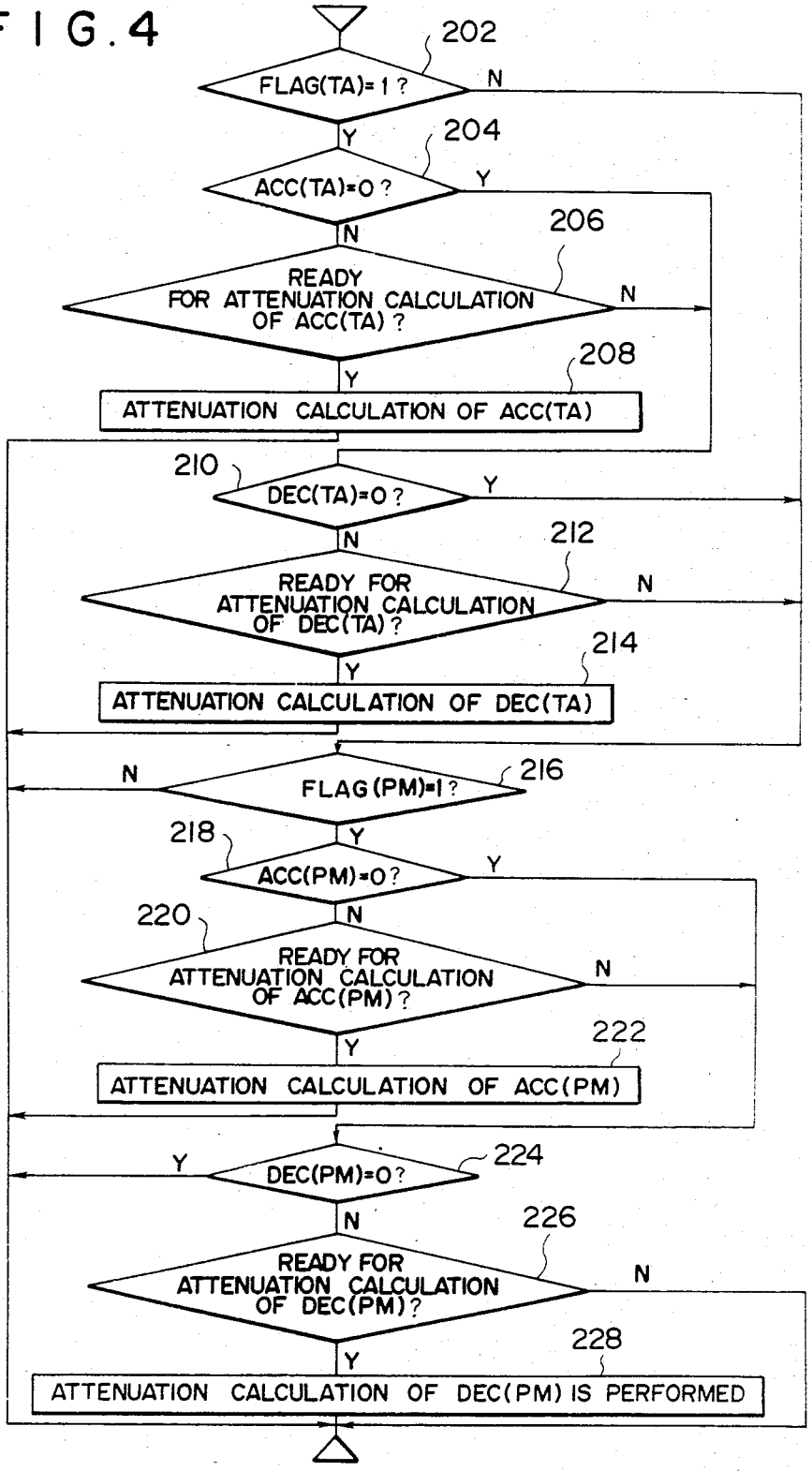
FIG. 4 is a flow chart showing the process for correcting the correction coefficient to "1" during the normal running condition in the above-mentioned embodiment.

FIG. 4 shows the procedural steps for causing the synchronous increases ACC(TA), ACC(PM) and the synchronous decreases DEC(TA), DEC(PM), all of which are stored in the RAM 42 according to the procedural steps shown in FIG. 3, to attenuate when the change $\Delta TA$ in opening degree of the throttle valve 6 is below a predetermined value or the change $\Delta PM$ in the intake manifold pressure is below a predetermined value so as to correct the correction coefficient $K_{TAV}$ of the second and third equations to "1". If it is judged that the flag (TA) and the flag (PM) are not set at "1" in Steps 202 and 216, then the change $\Delta TA$ in opening degree of the throttle valve 6 and the change $\Delta PM$ in the intake manifold pressure are above the predetermined values, respectively, that is, the engine is under acceleration or deceleration, so that the synchronous increases or the synchronous decreases, all of which are stored in the RAM 42, so not attenuate in value.

If it is judged that the flag (TA) is "1" in Step 202, then the process goes forward to Step 204, where it is judged if $ACC(TA)=0$ or not. If it is "no", the process goes forward to Step 206, where it is judged whether it is ready for performing an attenuation calculation for causing ACC(TA) to attenuate. If it is judged "yes" in step 206, then process goes forward to Step 208, where the attenuation calculation is performed. For example, the value stored in the RAM 42 is multiplied by 0.9, and the result thus calculated is stored in the RAM 42 as a new ACC(TA).

If it is judged that $ACC(TA)=0$ in Step 204, then the process goes forward to Step 210, where it is judged whether $DEC(TA)=0$ or not. If it is "no", the process goes forward to Step 212, where it is judged whether it is ready for performing the attenuation calculation to cause DEC(TA) to attenuate. If it is judged "yes" in Step 212, then the process goes forward to Step 214, where the above-described attenuation calculation is performed to rewrite DEC(TA) stored in the RAM 42.

If the flag (TA) is zero in Step 202, then the process goes forward to Step 216, where it is judged whether the flag (PM) is set at "1" or not. If it is "yes", the process goes forward to Step 218, where it is judged whether ACC(PM) equals to "0" or not. If it is "no" in Step 218, then the process goes forward to Step 220, where it is judged whether it is ready for performing the attenuation calculation. If if is "yes", then the process goes forward to Step 222, where the attenuation calculation is performed to rewrite ACC(PM) stored in the RAM 42.

If it is judged in Step 218 that ACC(PM) equals to "0", then the process goes forward to Step 224, where it is judged whether DEC(PM) equals to "0" or not. If it is "no", then the process goes forward to Step 226, where it is judged whether it is ready for performing the attenuation calculation or not. If it is "yes", then the process goes forward to Step 228, where the attenuation calculation is performed to rewrite the value of the synchronous decrease DEC(PM) stored in the RAM 42.

Figure 5:
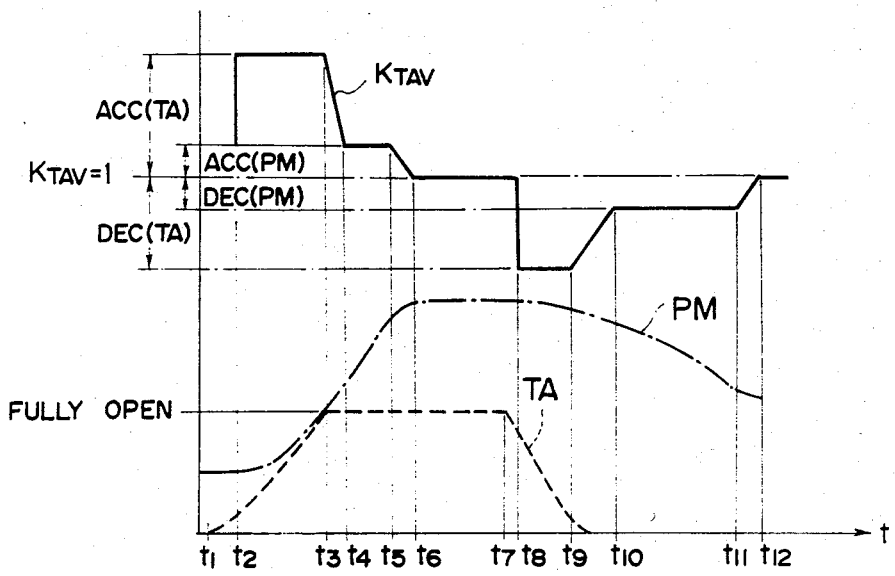
FIG. 5 is a time chart showing a change of the correction coefficient.

FIG. 5 shows the change in the correction coefficient $K_{TAV}$ when the opening degree of the throttle valve 6 is varied as indicated by a broken line TA and the intake manifold pressure is varied as indicated by a dot-dash-line PM. As shown by a time period between time points $t_1$ and $t_3$, if the opening degree of the throttle valve 6 is varied during acceleration, then the correction coefficient $K_{TAV}$ is changed to be (1+ACC(TA)) by the synchronous increase ACC(TA) at a time point $t_2$. When the change $\Delta TA$ in opening degree of the throttle valve 6 is decreased, the attenuation calculation of the synchronous increase ACC(TA) is started at the time point $t_3$.

As shown by a time period between the time points $t_2$ and $t_5$, the intake manifold pressure is varied as well, and, after a time point $t_4$ at which ACC(TA)$\leqq$ACC(PM), the synchronous increase ACC(PM) by the intake manifold pressure is also stored in the RAM 42. Until the time point $t_5$ at which $\Delta PM$ is decreased to less than a given value, the correction coefficient $K_{TAV}$ is maintained at (1+ACC(PM)). When the change $\Delta PM$ in the intake manifold pressure is decreased at the time point $t_5$, the attenuation calculation of the synchronous increase ACC(PM) stored in the RAM 42 is started. ACC(PM) equals to "0" at the time point $t_5$, so that the correction coefficient $K_{TAV}$ equals to "1" at the time point $t_5$.

Likewise, the correction coefficient $K_{TAV}$ during deceleration is varied as follows. As shown by a time period between time points $t_7$ and $t_9$, when, the opening degree of the throttle valve 6 is varied, the correction coefficient $K_{TAV}$ is changed by the synchronous decrease DEC(TA) to be (1+DEC(TA)) at a time point $t_8$. When the change $\Delta TA$ in the opening degree of the throttle valve 6 is decreased, the attenuation calculation of the synchronous decrease DEC(TA) is started at the time point $t_9$.

As shown by a time period between the time points $t_8$ and $t_{12}$, the intake manifold pressure is varied as well, after a time point $t_{10}$ at which DEC(TA)$\leqq$DEC(PM) (comparison by the absolute value), the synchronous decrease DEC(PM) by the intake manifold pressure is also stored in the RAM 42. Until a time point $t_{11}$ at which $\Delta PM$ is decreased to less than a given value, the correction coefficient $K_{TAV}$ is maintained at (1+DEC(PM)). When the change $\Delta PM$ in the intake manifold pressure is decreased at the time point $t_{11}$, the attenuation calculation of the synchronous decrease DEC(PM) stored in the RAM 42 is started. DEC(PM) equals to "0" at the time point $t_{12}$, so that the correction coefficient $K_{TAV}$ equals to "1" at the time point $t_{12}$.

When the synchronous increase ACC(TA) becomes smaller than the synchronous increase ACC(PM) in the process in which the synchronous increase ACC(TA) attenuates, the correction coefficient is changed from (1+ACC(TA)) to (1+ACC(PM)) in the above described embodiment. Alternatively, the correction coefficient may be made to be (1+ACC(TA)+ACC(PM)). This is true of the case of the synchronous decreases as well.

Furthermore, for the synchronous increases ACC(TA), ACC(PM), and the synchronous decreases DEC(TA), DEC(PM), values corresponding to the magnitudes of ΔTA and ΔPM are selected, respectively. Further, in the above-described embodiment, there is shown the case where ACC(TA) is larger in value than ACC(PM), however, there may be a case contrary to the above. This is true of the synchronous decreases as well.

What is claimed is:

1. An internal combustion engine with a fuel injection system comprising:

an injector for injecting fuel;

a rotational sensor for detecting a rotational speed of said engine;

a throttle sensor for detecting an opening degree of a throttle valve of said engine;

a pressure sensor for detecting pressure in an intake manifold of said engine;

first calculating means for calculating a basic injection time period, during which said injector injects fuel, based on the engine rotational speed detected by said rotation sensor and intake manifold pressure detected by said pressure sensor;

second calculating means for calculating a change with time of said opening degree detected by said throttle sensor and a change with time of said intake manifold pressure detected by said pressure sensor; and correcting means for correcting said basic injection time period under acceleration of said engine by alternatively using a first value effective when the increasing change of the opening degree of the throttle valve exceeds a first level and a second value effective when the increasing change of the intake manifold pressure exceeds a second level, said first value being large enough to provide a quick engine response and being attenuated when the change of the opening degree of the throttle value is below the first level and said second value being used to correct the basic injection time period only after the first value is below the second value.

2. An internal combustion engine as set forth in claim 1, wherein said corresponding means comprises:

comparing means for comparing said change with time of the opening degree and said change with time of the intake manifold pressure with predetermined values, respectively;

memory means for storing a first and a second values corresponding to predetermined fuel increase and fuel decrease commensurate to said change with time of the opening degree, and a third and a fourth values corresponding to predetermined fuel increase and fuel decrease commensurate to said change with time of the intake manifold pressure, on the basis of the results of comparison made by said comparing means; and third calculating means for calculating a correcting coefficient by use of said respective values stored in said memory means and correcting said basic injection time period by said correcting coefficient.

3. An internal combustion engine as set forth in claim 2, wherein said correcting coefficient is made to be (1+the content of said memory means), and said basic injection time period is multiplied by said correction coefficient to correct said basic injection time.

4. An internal combustion engine as set forth in claim 3, wherein, when said first value is larger than said third value, said correction coefficient is made to be (1+said first value), when the case is contrary to the above, said correction coefficient is made to be (1+said third value), when said second value is larger than said fourth value, said correction coefficient is made to be (1+said second value), and, when the case is contrary to the above, said correction coefficient is made to be (1+said fourth value).

5. An internal combustion engine as set forth in claim 2, wherein, when said change with time of the opening degree or said change with time of the intake manifold pressure is smaller than the respective predetermined values, the first through fourth values stored in said memory means are caused to attenuate, respectively, whereby said correction coefficient is caused to approach "1".

6. An internal combustion engine as set forth in claim 5, wherein, when said first through fourth values are "0", said attenuation calculation is terminated.

7. An internal combustion engine according to claim 1, said second value being attenuated when the change of the intake manifold pressure is below the second level, whereby the corrected basic injection time period is attenuated to approach to the basic injection time period.

8. An internal combustion engine according to claim 7, wherein the attenuation rate of the first value is larger than that of the second value.

9. An internal combustion engine according to claim 1, wherein said correcting means further corrects said basic injection time period under deceleration of the motor vehicle by alternatively using a third value effective when the decreasing change of the opening degree of the throttle valve exceeds a third level and a fourth value effective when the decreasing change of the intake manifold pressure exceeds a fourth level, said third value being large enough to provide an improved emission and being attenuated when the decreasing change of the opening degree of the throttle valve is below the third level, and said fourth value being used to correct the basic injection time period only after the third value is below the fourth value.

10. An internal combustion engine with a fuel injection system comprising:

an injector for injecting fuel;

a rotational sensor for detecting a rotational speed of said engine;

a throttle sensor for detecting an opening degree of a throttle valve of said engine;

a pressure sensor for detecting pressure in an intake manifold of said engine;

first calculating means for calculating a basic injection time period, during which said injector injects fuel, based on the engine rotational speed detected by said rotation sensor and intake manifold pressure detected by said pressure sensor;

second calculating means for calculating a change with time of said opening degree detected by said throttle sensor and a change with time of said intake manifold pressure detected by said pressurre sensor; and correcting means for correcting said basic injection time period under acceleration of the engine such that, when the increasing change of the opening degree exceeds a first level, said basic injection time period is stepwise increased by a first value being large enough to provide a quick engine response, when the increasing change of the opening degree is below the first level, said corrected basic injection time period is attenuated in accordance with attenuation of the first value until the first value is below a second value effective when the increasing change of the intake manifold pressure exceeds a second level, the second value being added to the basic injection time period until the increasing change of the intake manifold pressure is below the second level, and said corrected basic injection time period is attenuated in response to the increasing change of the intake manifold pressure being below the second level.

11. An internal combustion engine according to claim 10, wherein the attenuation rate of the first value is larger than that of the second value.

12. An internal combustion engine according to claim 10, wherein said correcting means further corrects the basic injection time under deceleration of the motor vehicle in such a manner that, when the decreasing change of the opening degree exceeds a third level, said basic injection time period is stepwise decreased by a third value being large enough to provide an improved emission and, when the decreasing change of the opening degree is below the third level, said corrected basic injection time period is attenuated in accordance with attenuation of the third value until the third value is below a fourth value effective when the decreasing change of the intake manifold pressure exceeds a fourth level, the fourth value being subtracted from the basic injection time period until the decreasing change of the intake manifold pressure is below the fourth level, and said corrected basic injection time period is attenuated in response to the decreasing change of the intake manifold pressure being below the fourth level.

* * * * *